US009327499B2

(12) United States Patent
Sakurai et al.

(10) Patent No.: US 9,327,499 B2
(45) Date of Patent: May 3, 2016

(54) LIQUID EJECTION HEAD AND SUBSTRATE

(71) Applicant: CANON KABUSHIKI KAISHA, Tokyo (JP)

(72) Inventors: Makoto Sakurai, Kawasaki (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/315,537

(22) Filed: Jun. 26, 2014

(65) Prior Publication Data

US 2015/0015632 A1 Jan. 15, 2015

(30) Foreign Application Priority Data

Jul. 9, 2013 (JP) ..... 2013-143349

(51) Int. Cl.
*B41J 2/335* (2006.01)
*B41J 2/14* (2006.01)

(52) U.S. Cl.
CPC .... *B41J 2/14129* (2013.01); *B41J 2002/14354* (2013.01); *B41J 2002/14387* (2013.01); *B41J 2202/18* (2013.01)

(58) Field of Classification Search
CPC ..... B41J 2/14016–2/14072; B41J 2/14088; B41J 2002/14177; B41J 2002/14185; B41J 2/335–2/33535; B41J 2/33595; B41J 2/05; B41J 2/0456; B41J 2/0458; B41J 2/14; B41J 2/045; B41J 2/33351; B41J 2/33515
USPC ..... 347/62
See application file for complete search history.

(56) References Cited

U.S. PATENT DOCUMENTS 7,172,268 B2 2/2007 Oikawa
7,954,238 B2 6/2011 Shibata
2001/0038396 A1* 11/2001 Imanaka ..... B41J 2/0451 347/7
2005/0128251 A1 6/2005 Lee (Continued)

FOREIGN PATENT DOCUMENTS

CN 1636735 A 7/2005
CN 1736716 A 2/2006

(Continued)

OTHER PUBLICATIONS

Chinese Office Action issued in counterpart application No. 201410323341.2 dated Aug. 3, 2015, along with its English language translation—18 pages.

*Primary Examiner* — Geoffrey Mruk
*Assistant Examiner* — Scott A Richmond
(74) *Attorney, Agent, or Firm* — Fitzpatrick, Cella, Harper & Scinto

(57) ABSTRACT

A liquid ejection head includes an ejection port for ejecting liquid, a liquid chamber communicating with the ejection port, and a substrate having a heat generating resistor arranged in the liquid chamber at a position corresponding to the ejection port and a bubble detecting device arranged on the heat generating resistor for controlling driving of the heat generating resistor by detecting a bubble produced by the heat generated by the heat generating resistor. The bubble detecting device has two electrodes arranged in the liquid chamber and, as viewed in the direction perpendicular to the substrate, one of the two electrodes is arranged at a position overlapping the heat generating resistor whereas the other one of the two electrodes is arranged at a position not overlapping the heat generating resistor.

11 Claims, 6 Drawing Sheets

(56) References Cited

U.S. PATENT DOCUMENTS

| | | | | |
|---|---|---|---|---|
| 2005/0140734 | A1 | 6/2005 | Oikawa | |
| 2005/0146594 | A1* | 7/2005 | Nakatani et al. | 347/193 |
| 2006/0033778 | A1* | 2/2006 | Shibata et al. | 347/59 |
| 2008/0188018 | A1 | 8/2008 | Shibata | |
| 2009/0309932 | A1 | 12/2009 | Kim | |
| 2011/0292131 | A1* | 12/2011 | Wei | B41J 2/14016 347/61 |

FOREIGN PATENT DOCUMENTS

| | | | |
|---|---|---|---|
| EP | 0576017 | A2 | 12/1993 |
| JP | 2005-231175 | A | 9/2005 |

* cited by examiner

| | CONTROL SIGNAL INPUT SECTION | BUBBLE DETECTING DEVICE | DRIVING DEVICE | HEAT GENERATING RESISTOR |
|---|---|---|---|---|
| T1 | ON | ON | ON | ON |
| T2 | ON | OFF | OFF | OFF |
| T3 | OFF | ON | OFF | OFF |

FIG. 5A1
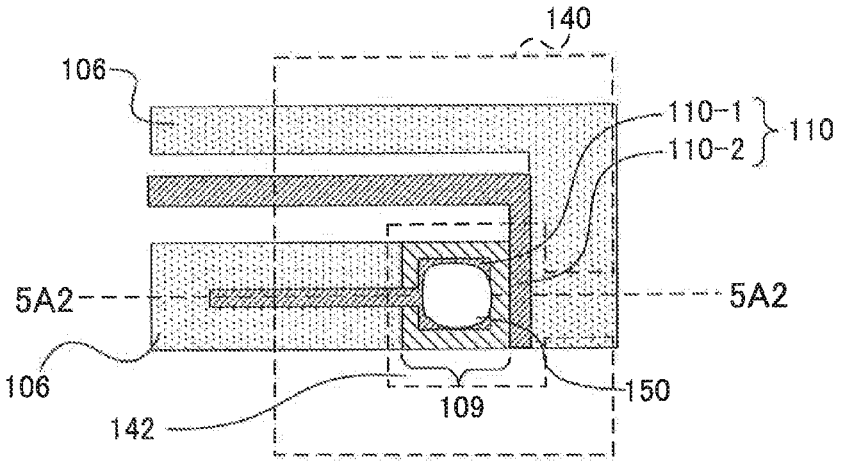
FIG. 5A2
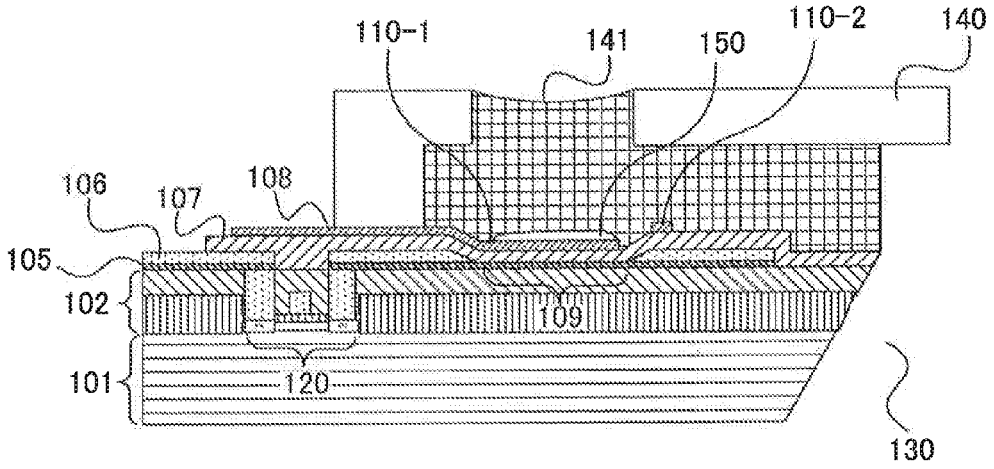

FIG. 5B1
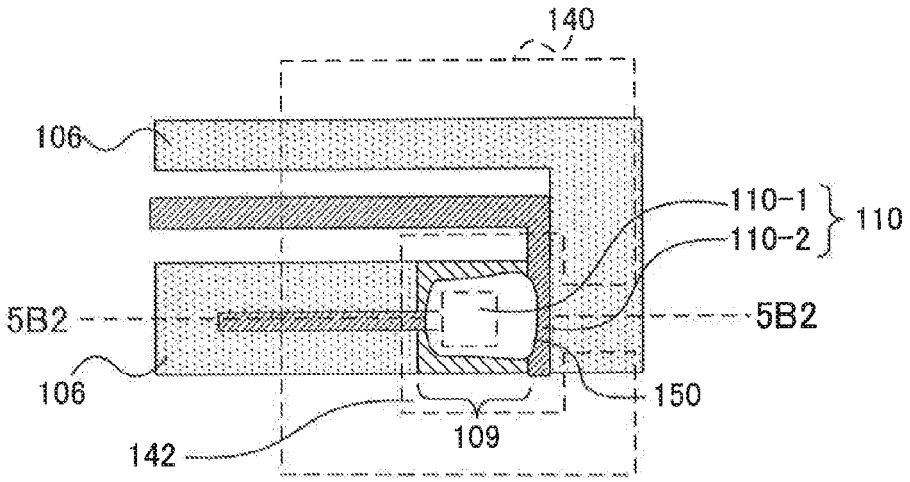
FIG. 5B2
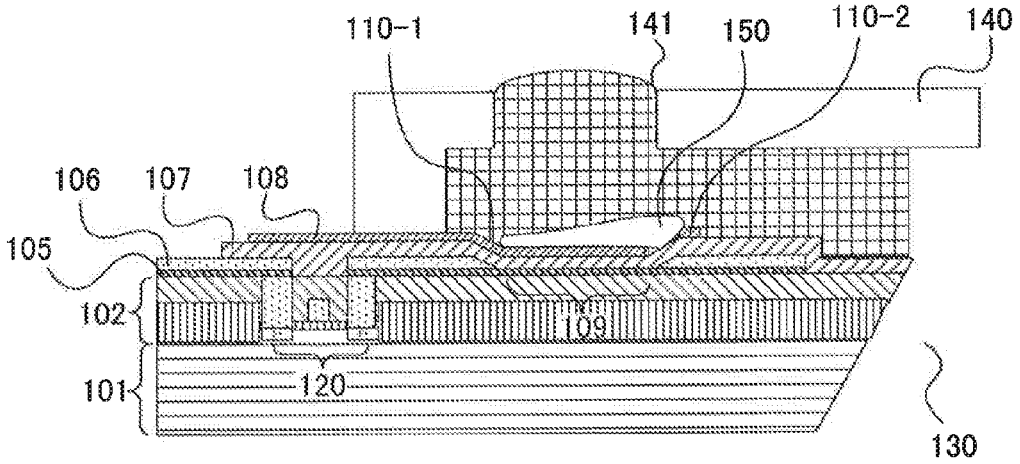

LIQUID EJECTION HEAD AND SUBSTRATE

BACKGROUND OF THE INVENTION

1. Field of the Invention

The present invention relates to a liquid ejection head for ejecting liquid droplets such as ink droplets and also to a substrate therefor. More particularly, the present invention relates to a liquid ejection head for ejecting liquid droplets by means of thermal energy.

2. Description of the Related Art

Techniques of electrically energizing a heat generating resistor to make it generate heat, bubbling ink by means of the heat generated by the heat generating resistor and causing ink droplets to be ejected from an ejection port under bubble pressure for recording purposes are known. With such a technique, the thermal energy generated for the purpose of ejecting ink is partly accumulated with time in the liquid ejection head that includes a base body on which heat generating resistors are mounted so that the temperature of the liquid ejection head gradually rises. Then, as a result, the temperature of the ink to be ejected from the liquid ejection head rises to by turn reduce the viscosity of the ink. The net result will be an increase in the quantity of ink droplets ejected from an ejection port of the liquid ejection head per unit time that by turn gives rise to an uneven density on the part of the image printed by the ejected ink.

Liquid ejection heads of the same type represent dispersion in terms of the resistance values of the wiring, the heat generating members and the driving devices of liquid ejection heads. As means for absorbing such dispersion, the liquid ejection head is designed to apply energy to the heat generating resistors thereof by about 1.2 times of the minimum electric power (or the minimum voltage) required for the liquid ejection head to bubble ink. This is one of the hidden reasons for producing such dispersion.

Under the above-described drive conditions, the surface temperature of the heat generating section of the liquid ejection head keeps on rising after bubbling ink in the above-described manner due to the excessive energy applied to that section. Then, as a result, the thermal stress in the liquid ejection head increases to give rise to a problem of an undesirably limited service life of the liquid ejection head.

Therefore, application of excessive energy is not desirable for liquid ejection heads of the above-described type. In view of this problem, Japanese Patent Application Laid-Open No. 2005-231175 proposes arranging a temperature sensor or a bubbling detection sensor on the surface of the heat generating section.

However, with the technique of detecting the surface temperature of the heat generating section of a liquid ejection head, there is no knowing if the surface of the heat generating section that contacts ink is in a state of nuclear boiling or in a state of film boiling. Then, there arises a difficulty of rectifying the rate at which bubbling energy is applied.

On the other hand, with the technique of detecting bubbling by arranging two electrodes in a region on the heat generating section of a liquid ejection head, ink on the heat generating section conducts electricity between the two electrodes and the application of a drive signal to a heat generating resistor is blocked when ink no longer exists between the electrodes due to growth of bubbles on the heat generating section. While bubbles need to spread over an area that is necessary for ink ejection (necessary bubbling region), with the technique of arranging two electrodes on the heat generating section, however, the positions and the sizes of the electrodes are subjected to limitations that are determined as a function of the necessary bubbling region. Therefore, one of the electrodes may be covered with a bubble before the bubble grows to a size that allows it to apply ejection energy to ink to prematurely block the application of a drive signal to the heat generating resistor, depending on the manner of spreading of bubbles. Then, as a result, the quantity of ejected liquid droplets or the rate of ejection of liquid droplets become instable to consequently degrade the quality of the image printed by the ejected ink.

SUMMARY OF THE INVENTION

According to the present invention, the above problems are dissolved by providing a liquid ejection head including: an ejection port for ejecting liquid; a liquid chamber communicating with the ejection port; and a substrate having a heat generating resistor arranged in the liquid chamber at a position corresponding to the ejection port and a bubble detecting device arranged on the heat generating resistor to control driving of the heat generating resistor by detecting a bubble produced by heat generated by the heat generating resistor; wherein the bubble detecting device has two electrodes arranged in the liquid chamber and, as viewed in the direction perpendicular to the substrate, one of the two electrodes is arranged at a position overlapping the heat generating resistor whereas the other one of the two electrodes is arranged at a position not overlapping the heat generating resistor.

Further features of the present invention will become apparent from the following description of exemplary embodiments with reference to the attached drawings.

BRIEF DESCRIPTION OF THE DRAWINGS

FIGS. 5A1, 5A2, 5B1 and 5B2 are schematic illustrations of production and spread of a bubble on a heat generating resistor that can be used for the purpose of the present invention.

DESCRIPTION OF THE EMBODIMENTS

Now, the present invention will be described in greater detail by referring to the accompanying drawings that illustrate currently preferred embodiments of the present invention. While the present invention is described below in terms of an inkjet recording head for printing ink images by ejecting ink droplets onto recording sheets as exemplary embodiments of the invention, the scope of application of the present invention is by no means limited to such inkjet recording heads.

Firstly, the configuration of an embodiment of the present invention, which is an inkjet recording head, will be described.

Figure 1A:
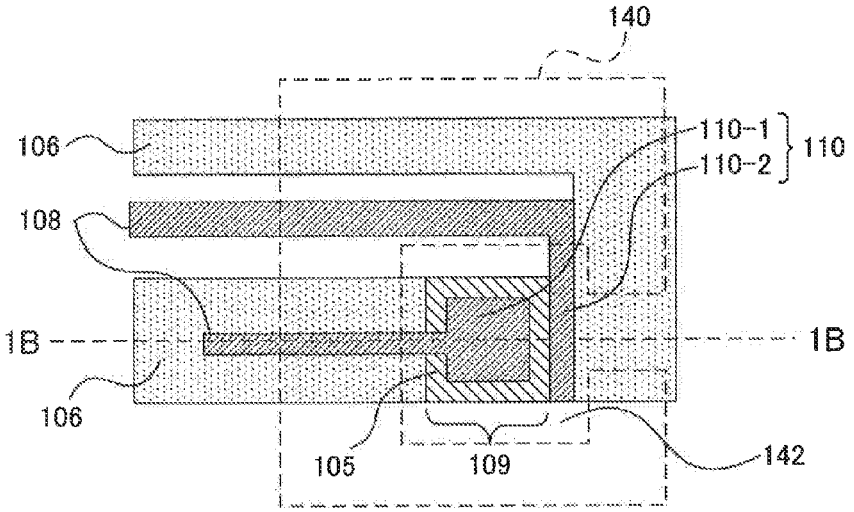
FIGS. 1A and 1B are schematic illustrations of the heat generating section and its vicinity of the substrate that is employed in an embodiment of inkjet recording head according to the present invention.
Figure 1B:
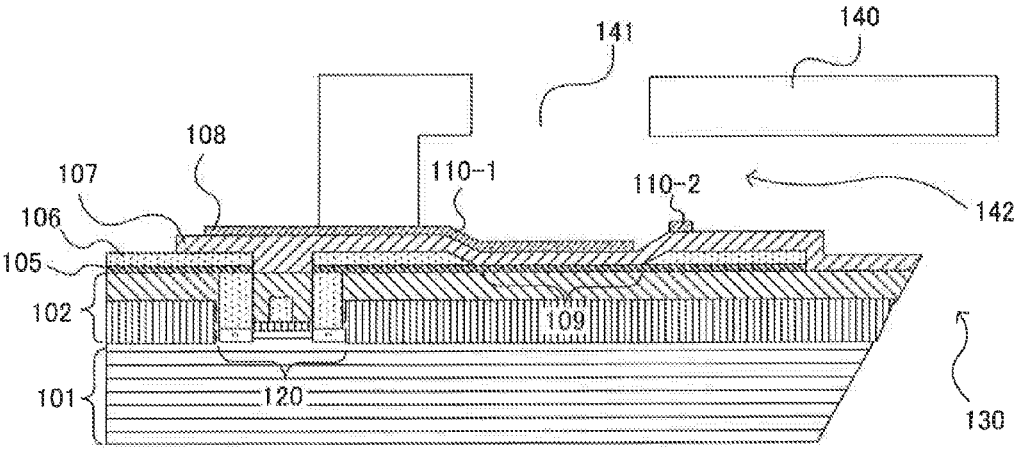

FIG. 1A is a schematic plan view of the heat generating section and its vicinity of the substrate constituting the inkjet recording head of the embodiment. FIG. 1B is a schematic cross sectional view of the substrate perpendicularly taken along line 1B-1B in FIG. 1A.

Referring to FIGS. 1A and 1B, the substrate of the inkjet recording head includes a structure where a heat storage layer 102, which is formed by using thermal oxidation film, SiO film, SiN film or the like, and a heat generating resistor layer 105 are sequentially laid on one of the surfaces of a silicon base body 101 in the above mentioned order. An electrode wiring layer 106, which is made of a metallic material such as Al, Al—Si, Al—Cu or the like, is formed on the heat generating resistor layer 105.

The heat generating resistor (heat generating section) 109 of the heat generating resistor layer 105 that operates as electro-thermal transducer device is formed by removing a part of the electrode wiring layer 106 to form a gap (a part that is devoid of the electrode wiring layer 106) and exposing the heat generating resistor layer 105 from that part.

A protective film layer 107 is provided over the heat generating resistor layer 109 and the electrode wiring layer 106. The protective film layer 107 is made of SiO film, SiN film or the like and also operates as insulating layer. A bubble detecting device 110 is formed on the protective film layer 107 to detect bubbles produced on the heat generating resistor 109. Note that the protective film layer 107 is omitted from FIG. 1A in order to completely represent the heat generating resistor 109 and the electrode wiring layer 106.

The electrode wiring layer 106 is electrically connected to a driving device 120 that is formed on the principal surface of the base body 101 and also to an external power supply terminal (not illustrated) so that the driving device 120 can control the power supply to the heat generating resistor 109 and hence the heat generation by the heat generating resistor 109.

The bubble detecting device 110 includes two electrodes arranged in a single liquid chamber 142. The electrodes includes a detection electrode portion 110-1 and a counter electrode portion 110-2, which is separated from and disposed opposite to the detection electrode portion 110-1. The detection electrode portion 110-1 is arranged on the heat generating resistor 109, while the counter electrode portion 110-2 is arranged in a region located outside the heat generating resistor 109. In other words, one of the two electrodes (or the electrode 110-1) is arranged at a position overlapping the heat generating resistor 109 whereas the other one of the two electrodes (or the electrode 110-2) is arranged at a position not overlapping the heat generating resistor 109 as viewed in the direction perpendicular to the substrate.

In this embodiment, the electrode portions 110-1 and 110-2 are made of a metal selected from the elements of the platinum group including Ta, Pt, Ir and Ru so that the electrode portions 110-1 and 110-2 have a cavitation-resistant (withstanding the impact of bubbling) function.

The bubble detecting device 110 detects initial bubbling from information on electric conduction between the electrode pair 110-1 and 110-2. When the bubbles produced on the heat generating resistor 109 are not large enough for satisfactory ejection of ink or when bubbles are made to grow non-uniformly on the heat generating resistor 109, the electrode pair (110-1, 110-2) is in a state of being electrically conductive to each other by way of ink (and hence the bubble detecting device 110 is ON: the state of T1 and that of T3 in FIGS. 4A and 4B).

On the other hand, as the temperature of the heat generating resistor 109 rises to move the ink that is in contact with the surface of the heat generating resistor 109 including the detection electrode portion 110-1 and move the ink as a result of bubbling, there will no longer be any ink interposed between the electrode pair (110-1, 110-2) of the bubble detecting device 110 and therefore there arises a state of not being electrically conductive between the electrode pair (110-1, 110-2). In other words, the state of the electrode pair changes (and hence the bubble detecting device 110 is OFF: the state of T2 in FIGS. 4A and 4B). Then, as a result, the bubble detecting device 110 can detect bubbles on the heat generating resistor 109 that have satisfactorily grown so as to be able to operate for ink ejection. In this way, the driving device 120 employs information on electric conduction or non-conduction between the two electrode portions as information on the bubble detecting device and controls the operation of driving the heat generating resistor 109 by using the information on electric conduction or non-conduction and a control signal. Thus, the embodiment of inkjet recording head can be operated with appropriate bubbling energy.

Note that, while the electrode wiring layer 106 is arranged on the heat generating resistor layer 105 in the instance illustrated in FIGS. 1A and 1B, an alternative arrangement of forming an electrode wiring layer 106 on the base body 101 or on the heat storage layer 102, producing a gap by partly removing the electrode wiring layer 106 and subsequently arranging a heat generating resistor layer may be adopted.

A fluid path forming member 140 is bonded to the substrate having the above-described arrangement as illustrated in FIG. 1B. The fluid path forming member 140 includes a fluid path including a liquid chamber 142 that surrounds the heat generating resistor 109 and an ejection port 141 that is formed to correspond to the heat generating resistor 109 for the purpose of ejecting liquid and communicates with the liquid chamber 142. A supply port 130 for supplying ink to the liquid chamber 142 is formed in the substrate of the inkjet recording head. In FIG. 1A, the fluid path forming member 140 is partly indicated by broken lines in order to represent the positional relationship between the detection electrode portions 110 and the liquid chamber 142. The above-described detection electrode portion 110-1 is arranged above the heat generating resistor 109 in the single liquid chamber 142, while the counter electrode portion 110-2 is arranged in a region not overlapping the heat generating resistor 109 in the single liquid chamber 142.

Now, the drive circuit of this embodiment will be described below.

Figure 3:
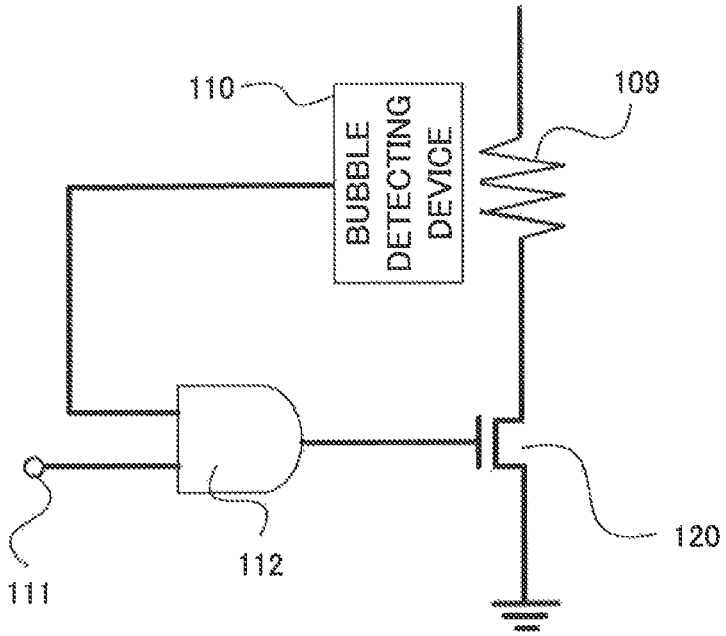
FIG. 3 is a schematic exemplar circuit diagram that can be used for the purpose of the present invention.

FIG. 3 is a schematic exemplar circuit diagram that can be used for this embodiment.

Referring to FIG. 3, a heat generating resistor 109 (heater) and a driving device 120 (transistor) are connected in series and one of the terminals of the heat generating resistor 109 that is not connected to the driving device 120 is connected to a power source (not illustrated), while one of the terminals of the driving device 120 that is not connected to the heat generating resistor 109 is grounded.

The bubble detecting device 110 and a control signal input section 111 are connected respectively to the two input terminals of an AND circuit 112 and the base side of the transistor that constitutes the driving device 120 is connected to the single output terminal of the AND circuit 112. As signals are input to the AND circuit 112 from both the bubble detecting device 110 and the control signal input section 111, the AND circuit 112 causes the base current to flow to the driving device 120. Then, as a result, the driving device 120 is turned ON to operate. More specifically, the electric current from the power source flows to the heat generating resistor 109. Note that a signal input from the bubble detecting device 110 to the AND circuit 112 is realized when the bubble detecting device 110 is in an ON state (when the electrode portions 110-1 and 110-2 are electrically conductive to each other by way of ink).

Figure 4A:
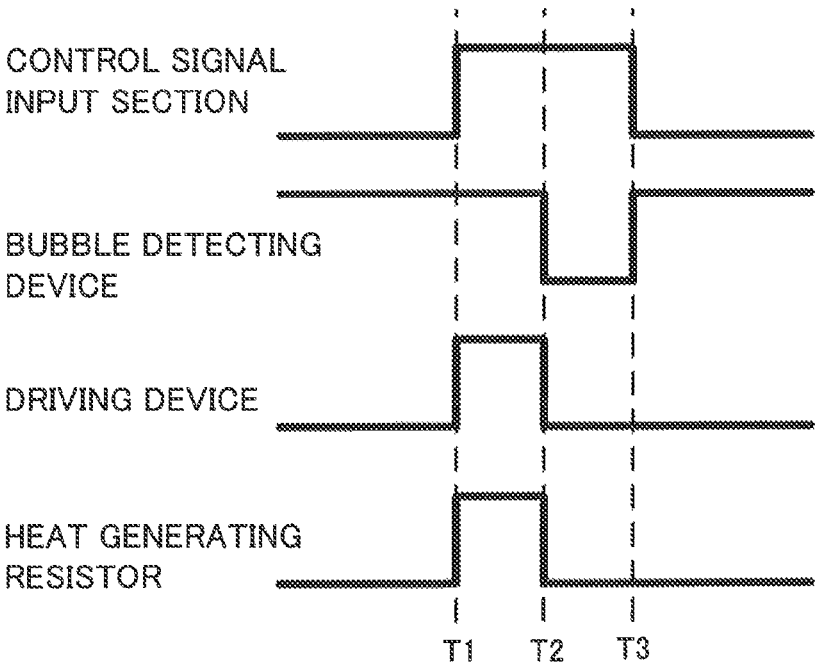
FIGS. 4A and 4B are schematic illustrations of an exemplary operation of the bubble detecting device, that of the driving device, and that of the heart generating resistor.
Figures 4B, 6:
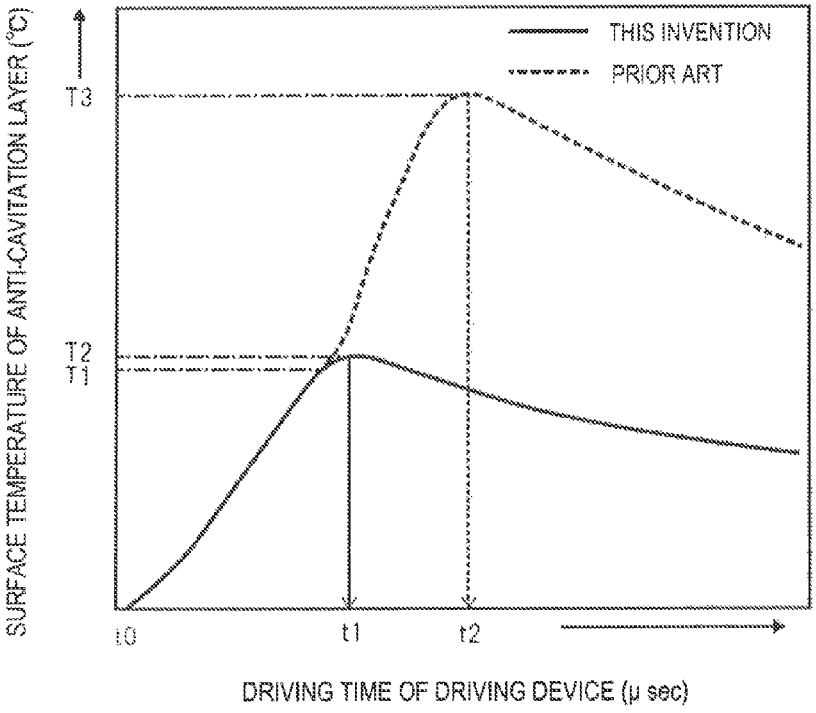
FIG. 6 is a schematic illustration of the relationship between the driving time of a driving device and the surface temperature of an anti-cavitation layer that is observed when the driving device is controlled by a bubble detecting device, which can be used for the purpose of the present invention, and those that are observed when the driving device is not controlled by the bubble detecting device, or the curves that represent the change with time of the surface temperature of an anti-cavitation layer.

FIGS. 4A and 4B are an exemplary ON/OFF timing chart of the control signal input section 111, the bubble detecting device 110, the heat generating resistor 109 and the driving device 120.

At timing T1, both the control signal input section 111 and the bubble detecting device 110 are in an ON state (and hence a control signal is present and the electrode portions 110-1 and 110-2 of the bubble detecting device 110 are in a state of electrically conductive to each other) so that the driving device 120 is driven to operate and the heat generating resistor 109 generates heat to cause the inkjet recording head to eject ink from the ejection port.

Normally, the liquid chamber 142 is filled with ink before bubbling starts and the electrode portions 110-1 and 110-2 are in a state of electrically conductive to each other. Therefore, before the start of liquid ejection, the bubble detecting device 110 is in an ON state. As the control signal input section 111 is turned ON in addition, the driving device 120 is turned ON and the heat generating resistor 109 is also turned ON so that the ink on the heat generating resistor 109 starts bubbling.

Then, bubbles grow and, when the energy necessary for ink ejection has been accumulated, the bubble detecting device 110 falls into an OFF state. As a result, the driving device 120 is turned OFF and the heat generating resistor 109 is also turned OFF (at timing T2).

As the heat generating resistor 109 is turned OFF, bubbles shrink so that ink is additionally supplied into the liquid chamber 142. Then, the bubble detecting device 110 is put into the ON state. At this timing, the control signal of the control signal input section 111 is put into the OFF state (at timing T3). Therefore, both the driving device 120 and the heat generating resistor 109 remain in the OFF stated until a control signal is input to them once again.

With the above-described control sequence, the excessive thermal stress, if any, applied to the base body 101 is reduced and an energy-saving and stable printing operation can be realized.

Because the detection electrode portion 110-1 and the counter electrode portion 110-2 of the bubble detecting device 110 are put into an electrically conductive state relative to each other by way of ink, electrically conductive ink needs to be employed for this embodiment.

Now, the configuration of this embodiment will be described more specifically below by way of examples.

Example 1

Referring to FIGS. 1A and 1B, the inkjet recording head of Example 1 includes a base body 101, a driving device 120, a supply port 130, wiring 106, a heat generating resistor 109, a fluid path forming member 140 and a heat storage layer 102.

The heat generating resistor 109 and a transistor that operates as the driving device 120 are formed on the base body 101, which is a silicon substrate.

The driving device 120 is formed by way of ion implantation and by forming a gate oxide film and an oxide film for element separation on the base body 101 as in the ordinary IC manufacturing process.

After forming polysilicon film for gate wiring, the gate oxide film is partly removed by etching and then a drain, a source and wiring of Al or the like are formed on the polysilicon film by sputtering.

Thereafter, an interlayer insulating film of SiO, SiN, SiON, SiOC, SiON or the like is formed by CVD for the heat storage layer 102. Then, the heat generating resistor layer 105 is formed by using TaSiN or the like and a reactive sputtering technique. Wiring 106 of Al or the like is formed thereon to form the region that becomes the heat generating resistor 109. Then, the protective film layer 107 (insulating film), which is made of SiN film or SiCN film, is formed by CVD. Subsequently, the anti-cavitation layer (to be abbreviated as anti-cavi layer hereinafter) 108 is formed by using Ta, Rt, Ir or Ru and sputtering.

Then, the bubble detecting device 110 is formed by processing the anti-cavi layer 108 by means of dry etching, using mixture gas of $Cl_2$, $BF_3$, Ar and the like. More specifically, the detection electrode 110-1 is formed on the heat generating resistor 109 by dry etching and the counter electrode 110-2 that is separated from the electrode 110-1 is formed at a position between the heat generating resistor 109 and the supply port 130.

Thus, one of the two electrodes of the bubble detecting device 110, or the electrode 110-1, is arranged on the heat generating resistor 109 while the other electrode 110-2 is arranged in a region that does not overlap the heat generating resistor 109. With such an arrangement, the possibility of blocking the drive signal to the heat generating resistor 109 before a sufficient amount of bubbling energy is input to the heat generating resistor 109 for liquid ejection can be suppressed so that initial bubbling can be accurately detected to control the driving device 120.

Note that the electrode 110-1 on the heat generating resistor 109 is made to represent a quadrangular shape to conform to the shape of the heat generating resistor 109. Preferably, the electrode portion 110-1 extends from the center of the heat generating resistor 109 and is arranged in the inside of the outer periphery of the heat generating resistor 109 but has an area not smaller than the area required to bubble ink to the extent necessary for ink ejection (necessary bubbling region). When the electrode 110-1 is arranged in the above-described manner, neither a groove shaped recess nor an irregular step is produced on the heat generating section so that bubbles can be formed so much more stably.

Then, external contact electrodes to be connected to the bubble detecting device 110 and other elements that operate for control signals for driving the power source and the driving device 120 are formed by partly opening the protective film 107 by etching and exposing the wiring 106.

As described above, after forming a driving device 120, wiring 106, a heat generating resistor 109 and a heat storage layer 102 on a base body 101, a fluid path forming member 140, which is made of a resin material, is formed on a member that can be removed to produce a fluid path in a later step by means of a spin coating technique. In actual inkjet recording heads, as a matter of fact, a plurality of ejection ports 141 and also a plurality of liquid chambers 142 are formed by photolithography. At this time, a heat generating resistor 109 and a bubble detecting device 110, which includes two electrodes 110-1 and 110-2, are arranged in each of the liquid chambers 142.

Then, supply ports 130 that communicate with the respective liquid chambers 142 are formed from the rear surface of the base body 101 by means of anisotropic etching, sand blasting, dry etching or the like.

Then, as illustrated in FIG. 3, AND circuits 112 are connected to the respective driving devices 120 from the outside by way of wiring 106 and the bubble detecting devices 110 and the signal control input sections 111 are connected respectively to the AND circuits 112 to control the heat generating resistors 109.

FIGS. 5A1, 5A2, 5B1 and 5B2 schematically illustrate how bubbles are produced and spread on each of the heat generating resistors 109. More specifically, FIGS. 5A1 and 5A2 illustrate a situation where bubbles 150 produced by film boiling has not yet satisfactorily covered one of the electrodes of the bubble detecting device 110, or the electrode 110-1, on the heat generating resistor 109.

As bubbles 150 spread further, there arises a situation where bubbles 150 completely cover the electrode 110-1 as illustrated in FIGS. 5B1 and 5B2. Since the resistance of the liquid in the part of the liquid chamber 142 that communicates with the ink supply port 130 is lower than the resistance of the liquid in the remaining part of the liquid chamber 142, the grown bubbles 150 are apt to spread in the direction toward the ink supply port 130. Thus, bubbles can easily be detected by arranging the other electrode 110-2 of the bubble detecting device 110 at the side of the ink supply port 130.

The inkjet recording head is manufactured by way of the above-described manufacturing steps.

When an inkjet recording head having the configuration as illustrated in FIGS. 1A and 1B is driven to eject liquid droplets, the driving time of the driving device is reduced if compared with any conventional inkjet recording heads so that the surface temperature of the anti-cavi layer 108 remains lower than ever. After driving the inkjet recording head to eject liquid droplets $1\times10^9$ times, the inkjet recording proved to be still able to realize energy-saving (electric power reduction) and stable printing.

Example 2

Figure 2A:
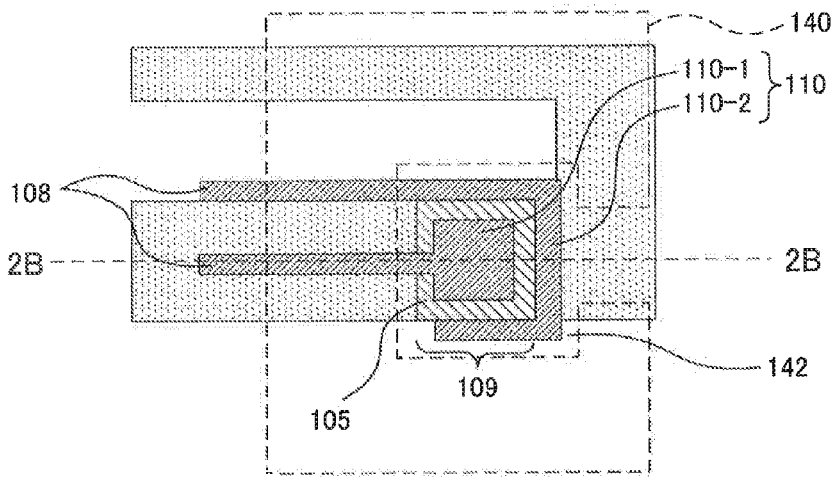
FIGS. 2A and 2B are schematic illustrations of the heat generating section and its vicinity of the substrate that is employed in another embodiment of inkjet recording head according to the present invention.
Figure 2B:
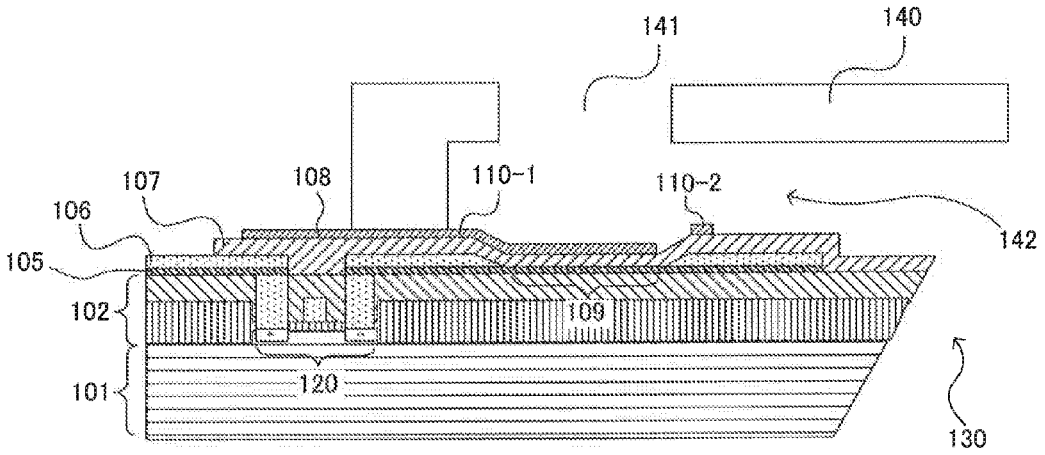

Now, the inkjet recording head of Example 2 will be described below. FIGS. 2A and 2B schematically illustrate the inkjet recording head of Example 2. FIG. 2A is a schematic plan view of the inkjet recording head and FIG. 2B is a schematic cross-sectional view of the substrate of the head taken perpendicularly along line 2B-2B in FIG. 2A.

The inkjet recording head of Example 2 is configurationally designed so as to be more reliably able to detect bubbles by taking the growth of bubbles into consideration. The inkjet recording head of Example 2 includes a base body 101, a driving device 120, a supply port 130, wiring 106, a heat generating resistor 109, a fluid path forming member 140 and a heat storage layer 102.

The heat generating resistor 109 and a transistor that operates as the driving device 120 are formed on the base body 101, which is a silicon substrate.

The driving device 120 is formed by employing ion implantation and by forming a gate oxide film and an oxide film for element separation on the base body 101 as in the ordinary IC manufacturing process.

After forming polysilicon film for gate wiring, the gate oxide film is partly removed by etching and then a drain, a source and wiring of Al or the like are formed on the polysilicon by sputtering.

Thereafter, an interlayer insulating film of SiO, SiN, SiON, SiOC, SiON or the like is formed by CVD for the heat storage layer 102. Then, the heat generating resistor layer 105 is formed by using TaSiN or the like and a reactive sputtering technique. Wiring 106 of Al or the like is formed thereon and the region that becomes the heat generating resistor 109 is exposed to the outside. Then, the protective film layer 107 (insulating film), which is made of SiN film or SiCN film, is formed thereon by CVD. Subsequently, the anti-cavitation layer (to be abbreviated as anti-cavi layer hereinafter) 108 is formed by using Ta, Rt, Ir or Ru and sputtering.

Then, the bubble detecting device 110 is formed by processing the anti-cavi layer 108 by means of dry etching, using mixture gas of $Cl_2$, $BF_3$, Ar and the like. More specifically, the electrode 110-1 is formed on the heat generating resistor 109 by dry etching and the counter electrode 110-2 that is separated from the electrode 110-1 is formed so as to surround the heat generating resistor 109. In this example, the electrode 110-2 is arranged along three of the four sides of the heat generating resistor 109 that is rectangular in shape.

Thus, one of the two electrodes of the bubble detecting device 110, or the electrode 110-1 is arranged on the heat generating resistor 109 and the other electrode 110-2 is arranged in a region that does not overlap the heat generating resistor 109. With such an arrangement, the possibility of blocking the drive signal to the heat generating resistor 109 before a sufficient amount of bubbling energy is input to the heat generating resistor 109 for liquid ejection can be suppressed so that initial bubbling can be accurately detected to control the driving device 120.

Note that the electrode 110-1 on the heat generating resistor 109 is made to represent a quadrangular shape to conform to the shape of the heat generating resistor 109. The electrode section 110-1 is desirably made to extend from the center of the heat generating resistor 109 and arranged in the inside of the outer periphery of the heat generating resistor 109 but has an area not smaller than the area required to bubble to the extent necessary for ejecting ink (necessary bubbling region).

Then, an external contact electrode to be connected to the bubble detecting device 110 and other elements that operate for the control signal for driving the power source and the driving device 120 is formed by partly opening the protective film 107 by etching and exposing the wiring 106.

As described above, after forming a driving device 120, wiring 106, a heat generating resistor 109 and a heat storage layer 102 on a base body 101, a fluid path forming member 140, which is a resin material, is formed on a member that can be removed to form a fluid path in a later step by means of spin coating. In actual inkjet recording heads, as a matter of fact, a plurality of ejection ports 141 and liquid chambers 142 are formed by photolithography. At this time, a heat generating resistor 109 and a bubble detecting device 110, which includes two electrodes 110-1 and 110-2, are arranged in each of the liquid chambers 142.

Then supply ports 130 that communicate with the respective liquid chambers 142 are formed from the rear surface of the base body 101 by means of anisotropic etching, sand blasting, dry etching or the like.

Then, as illustrated in FIG. 3, AND circuits 112 are connected to the respective driving devices 120 from the outside by way of wiring 106 and the bubble detecting devices 110 and the control signal input sections 111 are connected respectively to the AND circuits 112 to control the heat generating resistors 109.

The inkjet recording head is manufactured by way of the above-described manufacturing steps.

When the inkjet recording head having the configuration as illustrated in FIGS. 2A and 2B is driven to eject liquid droplets, inkjet recording proved to be able to realize energy-saving (electric power reduction) and stable printing more than the inkjet recording head of Example 1 (having the configuration illustrated in FIGS. 1A and 1B).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of the Japanese Patent Application No. 2013-143349, filed Jul. 9, 2013, which is hereby incorporated by reference herein in its entirety.

What is claimed is:

1. A liquid ejection head comprising:

an ejection port for ejecting liquid;

a liquid chamber communicating with the ejection port; and a substrate having a heat generating resistor arranged in the liquid chamber at a position corresponding to the ejection port and a bubble detecting device arranged on the heat generating resistor to control driving of the heat generating resistor by detecting a bubble produced by heat generated by the heat generating resistor, wherein the bubble detecting device has a first electrode and a second electrode arranged in the liquid chamber and, as viewed in a direction perpendicular to the substrate, the first electrode is arranged at a position overlapping the heat generating resistor whereas the second electrode is arranged at a position not overlapping the heat generating resistor, and wherein the first electrode has an area in a direction along the substrate that is smaller than that of the heat generating resistor.

2. The liquid ejection head according to claim 1, wherein the substrate has a supply port for supplying liquid to the heat generating resistor; and wherein the second electrode is arranged between the supply port and the heat generating resistor.

3. The liquid ejection head according to claim 1, wherein at least one of the first electrode and the second electrode is made of a material selected from Ta, Pt, Ir and Ru.

4. The liquid ejection head according to claim 1, wherein the first electrode is formed inside the heat generating resistor; and wherein the first electrode has an area larger than a bubbling area necessary for liquid ejection.

5. A substrate comprising:

a heat generating resistor for generating thermal energy to be utilized for liquid ejection; and a bubble detecting device arranged on the heat generating resistor to control driving of the heat generating resistor by detecting a bubble produced by heat generated by the heat generating resistor, wherein the bubble detecting device has a first electrode and a second electrode and, as viewed in a direction perpendicular to the substrate, the first electrode is arranged at a position overlapping the heat generating resistor whereas the second electrode is arranged at a position not overlapping the heat generating resistor, and wherein the first electrode has an area in a direction along the substrate that is smaller than that of the heat generating resistor.

6. The substrate according to claim 5, wherein the substrate has a supply port for supplying liquid to the heat generating resistor; and wherein the second electrode is arranged between the supply port and the heat generating resistor.

7. The substrate according to claim 5, wherein at least one of the first electrode and the second electrode is made of a material selected from Ta, Pt, Ir and Ru.

8. A liquid ejection head comprising:

an ejection port for ejecting liquid;

a liquid chamber communicating with the ejection port; and a substrate having a heat generating resistor arranged in the liquid chamber at a position corresponding to the ejection port;

a first electrode, as viewed in a direction perpendicular to the substrate, arranged at a position overlapping the heat generating resistor and having an area in a direction along the substrate that is smaller than that of the heat generating resistor;

a second electrode, as viewed in a direction perpendicular to the substrate, arranged at a position not overlapping the heat generating resistor;

a bubble detecting device configured to detect a bubble produced by heat generated by the heat generating resistor by electrically energizing the first electrode or the second electrode; and a control unit configured to control driving of the heat generating resistor according to a result of the detection of the bubble by the bubble detecting device.

9. The liquid ejection head according to claim 8, wherein the substrate has a supply port for supplying liquid to the heat generating resistor; and wherein the second electrode is arranged between the supply port and the heat generating resistor.

10. The liquid ejection head according to claim 8, wherein at least one of the first electrode and the second electrode is made of a material selected from Ta, Pt, Ir and Ru.

11. The liquid ejection head according to claim 8, wherein the first electrode is formed inside the heat generating resistor; and wherein the first electrode has an area larger than a bubbling area necessary for liquid ejection.

* * * * *